US006302298B1

(12) United States Patent
Chernov et al.

(10) Patent No.: US 6,302,298 B1
(45) Date of Patent: Oct. 16, 2001

(54) SQUEEZEABLE CONTAINER ASSEMBLY

(75) Inventors: Yuriy Chernov; Gennady Kleyman, both of Brooklyn, NY (US)

(73) Assignee: Ratchetube, LLC, NY (US)

( * ) Notice: Subject to any disclaimer, the term of this patent is extended or adjusted under 35 U.S.C. 154(b) by 0 days.

(21) Appl. No.: 09/685,263

(22) Filed: Oct. 10, 2000

Related U.S. Application Data

(63) Continuation of application No. 09/116,609, filed on Jul. 16, 1998, now abandoned.

(51) Int. Cl.[7] ..... B65D 35/28
(52) U.S. Cl. ..... 222/103; 222/95
(58) Field of Search ..... 222/95, 103

(56) References Cited

U.S. PATENT DOCUMENTS

| | | | | |
|---|---|---|---|---|
| 3,313,455 | * | 4/1967 | Kemmer | 222/103 |
| 3,536,234 | * | 10/1970 | Rise | 222/103 |
| 4,448,333 | * | 5/1984 | Ferrari | 222/103 X |
| 4,579,254 | * | 4/1986 | Puskarcik | 222/95 |
| 4,928,851 | | 5/1990 | Eatherly | 222/103 |
| 5,071,036 | | 12/1991 | Kelly et al. | 222/103 |
| 5,167,348 | | 12/1992 | Okami et al. | 222/103 |
| 5,222,629 | | 6/1993 | Tal | 222/103 |
| 5,277,335 | | 1/1994 | Okami et al. | 222/103 X |
| 5,501,369 | | 3/1996 | Tal | 222/103 |
| 5,657,903 | | 8/1997 | Roberts | 222/95 X |
| 5,857,593 | | 1/1999 | Patronaggio | 222/103 |

* cited by examiner

*Primary Examiner*—Kenneth Bomberg
(74) *Attorney, Agent, or Firm*—Cowan, Liebowitz & Latman, P.C.

(57) ABSTRACT

A container for a squeezeable out material has an elongated container part having an outlet opening, a squeezing out mechanism for squeezing the material from an interior of the container part through the outlet opening by displacing the squeezing out mechanism toward the outlet opening, and a structure for preventing a displacement of the squeezing out mechanism in an opposite direction.

5 Claims, 4 Drawing Sheets

SQUEEZEABLE CONTAINER ASSEMBLY

This application is a continuation of U.S. patent application Ser. No. 09/116,609, filed Jul. 16, 1998, now abandoned.

BACKGROUND OF THE INVENTION

The present invention relates to containers for squeezeable out materials, such as for example two spaced containers, gel containers, cream containers, etc.

It is known that in known containers after a substantial use of the material accommodated in them, a certain amount of the material is also left over. Also, forcing the material out of the container is many instances uncomfortable.

Some of the squeezing out mechanisms are disclosed for example in U.S. Pat. Nos. 5,071,036, 5,167,348, 5,222,629, 5,277,335, 5,501, 369.

SUMMARY OF THE INVENTION

Accordingly, it is an object of the present invention to provide a container for squeezeable material which avoids the disadvantages of the prior art.

More particularly, it is an object of present invention to provide a container for squeezeable material, which guarantees that the whole volume of the material accommodated in it can be dispensed, and also dispensing of the material or forcing the material from the container is facilitated.

In keeping with these objects and with others which will become apparent hereinafter, one feature of present invention resides, briefly stated in a container for a squeezeable material which has a container part forming an interior for accommodated a material, and a squeezing out mechanism which is displaceable along the container towards its opening and during the displacement squeezes the container so as to squeeze the material from the container, wherein in accordance with the present invention the squeezing out mechanism is provided means for allowing its displacement only in a direction toward the outlet opening and prevents its displacement in an opposite direction.

When the container is designed in accordance with the present invention it eliminates the disadvantages of the prior art.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
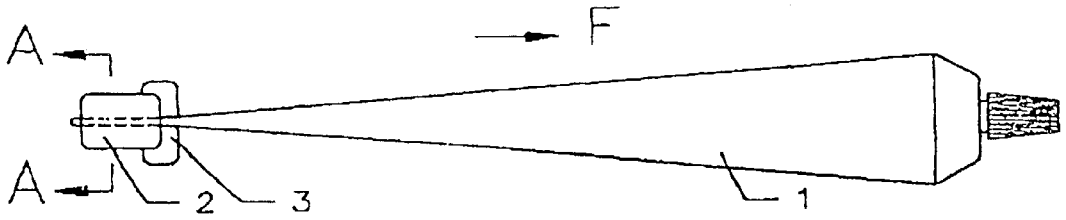
FIG. 1 is a front view of a container with a squeezing out mechanism located in a starting position.
Figure 2:
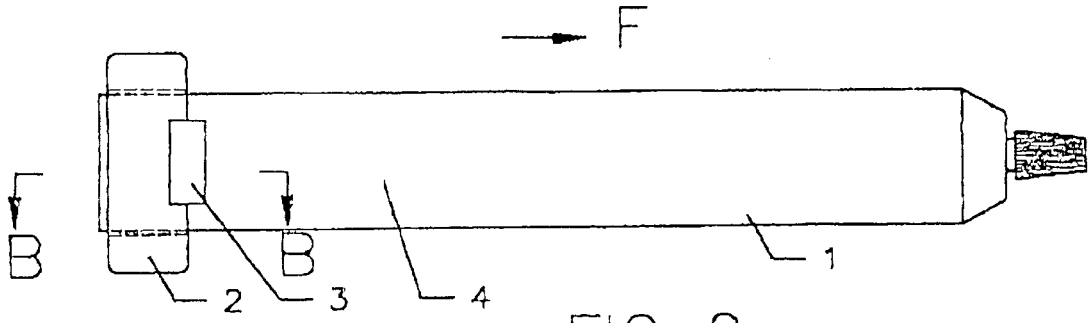
FIG. 2 is a top view of the container with the squeezing out mechanism of FIG. 1.
Figure 3:
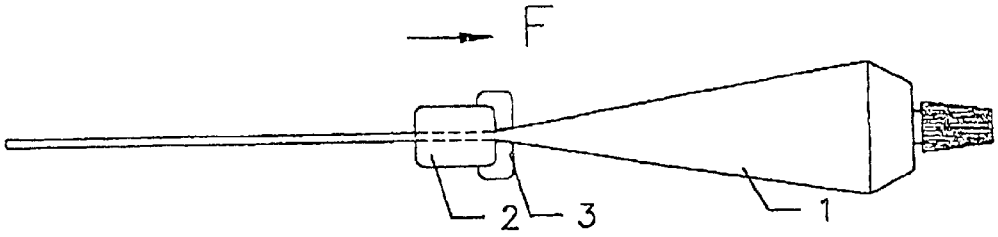
FIG. 3 is a front view of the container when the squeezing mechanism has moved forward.

A container for a squeezeable material in accordance with the present invention has a container part formed for example as a tube and identified with the reference numeral 1. The tube has a hollow interior for accommodating of a squeezeable material and an opening closeable by a cover as shown in the right hand side in FIGS. 1–4 and 10–12. In accordance with the present invention, a squeezing out mechanism is provided for squeezing out the material from the interior of the tube 1. The squeezing out mechanism is identified with the reference numeral 2 which has means allowing a displacement of the squeezing out mechanism along the tube 1 toward the outlet opening and preventing the displacement of the squeezing out mechanism in an opposite direction. The above mentioned preventing means is formed for example on a portion 3 of the squeezing out mechanism.

The squeezing mechanism 2 can be formed as a peripherally enclosed frame having a central opening. The height T of the central opening must be at least equal to a double thickness of the wall of the tube 1 or insignificantly greater than it. The length S of the central opening must be somewhat longer than the transverse width of the tube 1.

Figure 6:
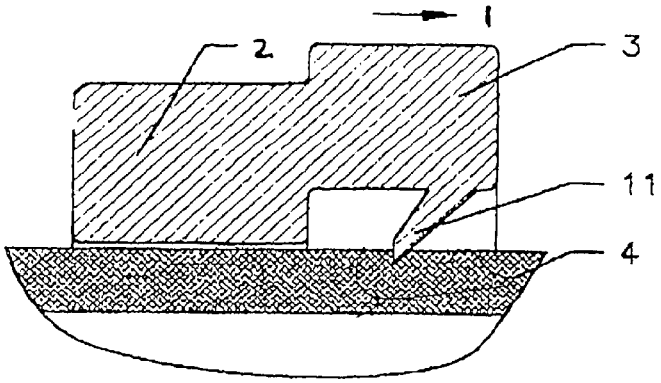
FIG. 6 is a view showing a section taken along the line B—B of FIG. 2 of another embodiment of the present invention.
Figure 7:
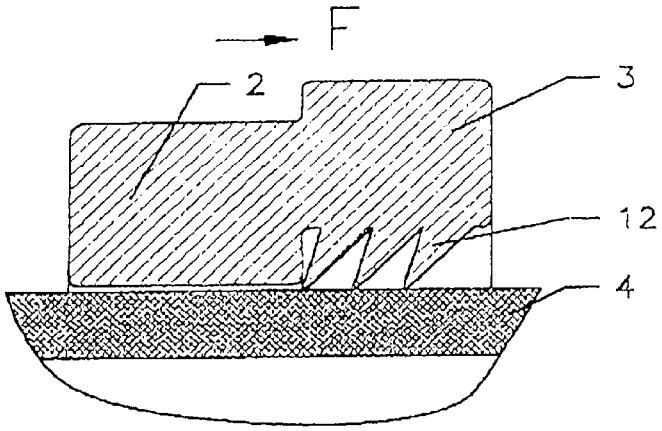
FIG. 7 is a view substantially corresponding to the view of FIG. 6 but showing still a further embodiment of the present invention.

The means for preventing the displacement of the squeezing out mechanism in the opposite direction in the embodiment of FIG. 6 include one or several teeth 11. Each tooth is formed so that during displacement of the squeezing out mechanism toward the opening the tooth yields rearwardly, but in response to an attempt to move the squeezing out mechanism in the opposite direction it engages or wedges into the surface 4 of the tube 1. For this purpose, the tooth or teeth 11 have a hardness which is greater than the hardness of the surface of the tube 1. In the embodiment of FIG. 7, the teeth 12 have a hardness or equal or even smaller than the hardness of the surface of the tube 1. However, they are arranged one behind the other in direction of the displacement of the squeezing out mechanism along the tube. Therefore when an attempt is made to displace the squeezing out mechanism in an opposite direction, the successfully arranged teeth 12 prevent such a displacement.

Figure 4:
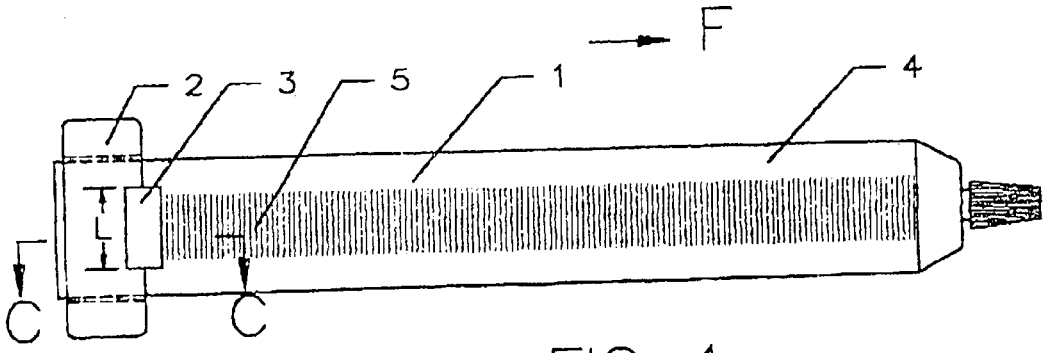
FIG. 4 is a top view of the container in accordance with a further embodiment of the present invention.
Figure 5:
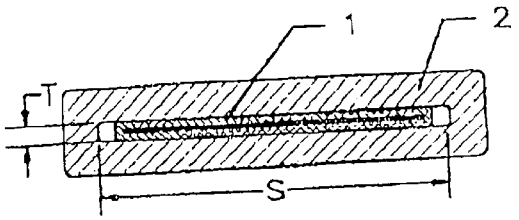
FIG. 5 is a view showing a section taken along the line A—A in FIG. 1.
Figure 8:
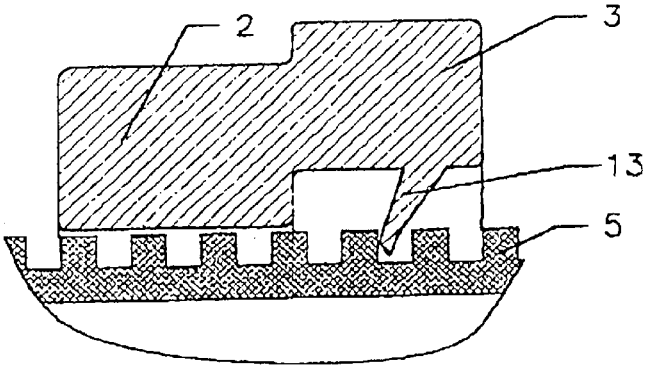
FIG. 8 is a view substantially corresponding to the view of FIG. 6 but showing an additional embodiment of the present invention.

In the embodiment of FIGS. 4 and 8, the surface of the tube 1 is provided with a plurality of depressions and projections 5. A tooth or teeth 13 are arranged on the squeezing out mechanism and formed so that during the displacement of the squeezing out mechanism in direction toward the outlet opening the teeth yield and jump from one depression into the other, while when an attempt is made to displace the squeezing out mechanism in an opposite direction, the teeth 13 abut against the corresponding flanks of the projections. As can be seen from FIGS. 6, 7, 8, the teeth are inclined in a direction opposite to the direction of the displacement of the squeezing out mechanism toward the opening.

Figure 9:
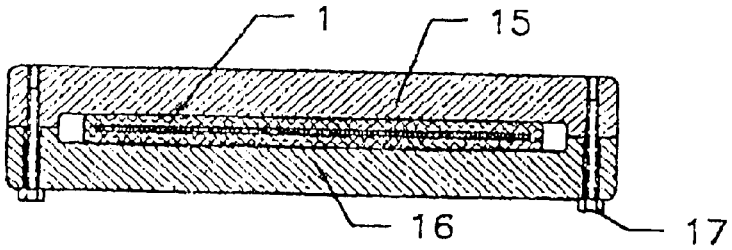
FIG. 9 is a view showing a section A—A of FIG. 1 with the squeezing out mechanism in accordance with a further embodiment of the present invention.

FIG. 9 shows another embodiment of the squeezing out mechanism. In this embodiment the squeezing out mechanism is formed as a frame which is composed of two semi-frames 15 and 16. The semi-frames 15, 16 are connected with one another by bolt 17. With this construction its very simple to first of all disassemble the squeezing mechanism, then to put the semi-frames at opposite sides of the tube, and then to attach them to one another by the bolts 17 on the existing tube.

Figure 10:
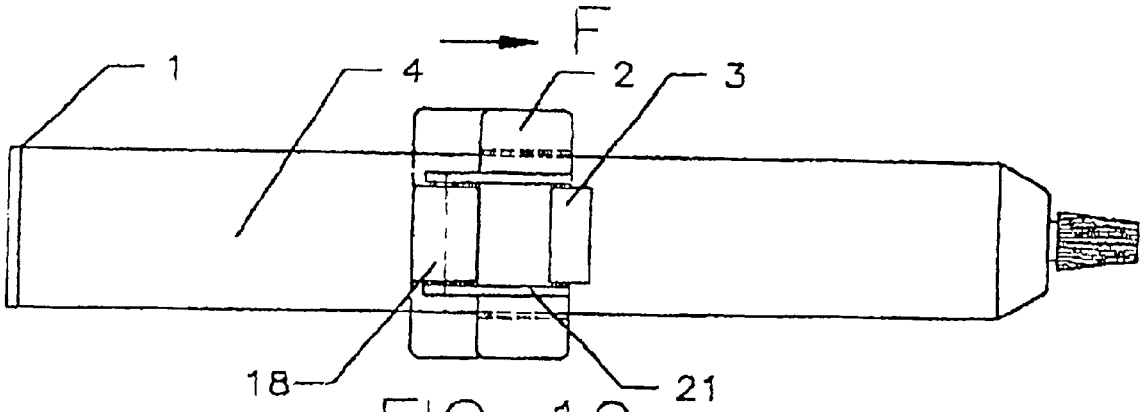
FIG. 10 is a top view of the container in accordance with the present invention with a squeezing out mechanism in accordance with another embodiment.

FIG. 10 shows a further embodiment of the squeezing out mechanism. Here the squeezing out mechanism 2 is provided with a roller 18 which frictionally engages the surface of the tube 1. The roller 18 is held rotatably in the lateral supports 21.

Figure 11:
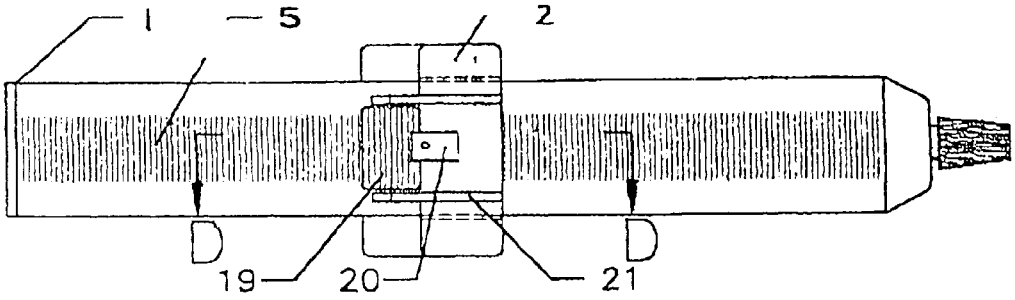
FIG. 11 is a view substantially corresponding to the view of FIG. 10 but showing still a further embodiment of the present invention.
Figure 12:
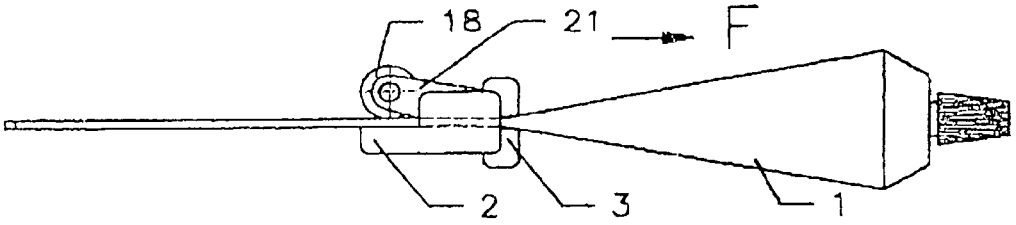
FIG. 12 is a side view of the container of FIG. 11.
Figure 13:
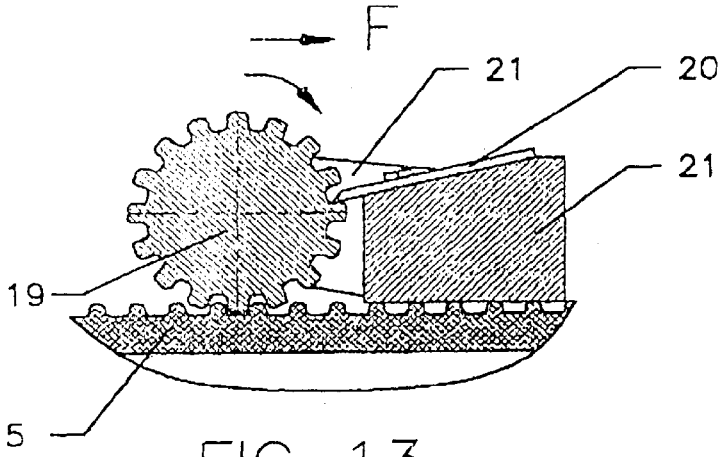
FIG. 13 is a section taken along the line D—D in FIG. 11.

FIGS. 11–13 illustrates still a further embodiment of the present invention. Here the squeezing out mechanism includes a roller 19 provided with a plurality of teeth with its periphery, and a catch 20 mounted on the frame of the squeezing mechanism. The catch 20 is arranged so as to project into spaces between the teeth of the roller 19, so that during displacement of the squeezing out mechanism in direction toward the outlet opening, the teeth of the roller 19 elastically deviates the catch 22 with the catch 20. However, when an attempt is made to move the squeezing out mechanism in an opposite direction, the catch 20 reliably prevents rotation of the roller 19 in an opposite direction.

Figure 14:
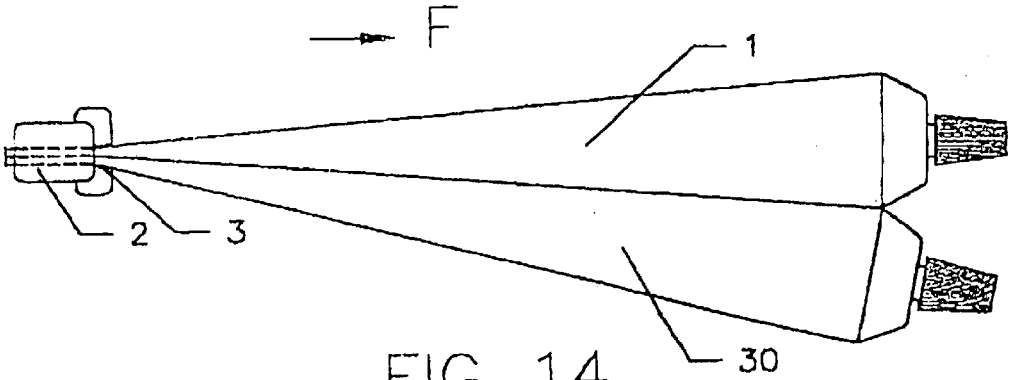
FIG. 14 shows a further embodiment of the invention.

As shown in FIG. 14, two containers 1 and 30 can be emptied with the same mechanism.

It will be understood that each of the elements described above, or two or more together, may also find a useful application in other types of constructions differing from the types described above.

While the invention has been illustrated and described as embodied in container for squeezeable out material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A container for material that can be squeezed out, said container comprising:

an elongated container member having an outlet opening, said container member having a flexible wall on which a plurality of depressions and projections are arranged in the longitudinal direction; and a squeezing mechanism surrounding an exterior of the container member for squeezing material from the interior of the container member through said outlet opening, wherein said squeezing mechanism has a discontinuous contact surface urging against the flexible wall of the container member, wherein said squeezing mechanism is displaced toward the outlet opening as it engages said depressions and projections and causes the material to be squeezed out from the outlet opening, and wherein said discontinuous contact surface is shaped to arrest displacement of the squeezing mechanism in an opposite direction.

2. A container as defined in claim 1, wherein said discontinuous surface is formed with at least one tooth provided on said squeezing mechanism and formed so that it allows displacement of the squeezing mechanism in the direction toward said outlet opening, but when an attempt is made to displace the squeezing mechanism in said opposite direction it engages a surface of the container part and prevents displacement of the squeezing mechanism in the opposite direction.

3. A container as defined in claim 2, wherein said at least one tooth has a hardness which is greater than the hardness of the surface of said container part.

4. A container as defined in claim 2, wherein said tooth is engageable in said depressions and formed so that during the displacement of said squeezing mechanism in the direction toward said outlet opening said tooth moves from one depression to the other, but when an attempt is made to displace said squeezing mechanism in the opposite direction the tooth abuts against a flank of the corresponding projection and prevents such a displacement.

5. A container as defined in claim 1, wherein said squeezing mechanism is formed as an integral frame having a central opening for passing of said container member.

* * * * *